US008588438B2

(12) United States Patent
Tseng et al.

(10) Patent No.: US 8,588,438 B2
(45) Date of Patent: Nov. 19, 2013

(54) DRIVING INTERFACE DEVICE ADAPTIVE TO A FLAT SPEAKER

(75) Inventors: Kuo-Hua Tseng, Taipei County (TW); Chang-Ho Liou, Changhua County (TW); Ming-Daw Chen, Hsinchu (TW); Kuan-Wei Chen, Taichung County (TW); Che-Yuan Sun, Hualien County (TW)

(73) Assignee: Industrial Technology Research Institute, Hsinchu (TW)

( * ) Notice: Subject to any disclaimer, the term of this patent is extended or adjusted under 35 U.S.C. 154(b) by 260 days.

(21) Appl. No.: 12/981,508

(22) Filed: Dec. 30, 2010

(65) Prior Publication Data

US 2012/0106761 A1 May 3, 2012

(30) Foreign Application Priority Data

Nov. 3, 2010 (TW) ..... 99137799 A

(51) Int. Cl.
*H04R 25/00* (2006.01)
*H04R 3/00* (2006.01)
*H04R 1/00* (2006.01)

(52) U.S. Cl.
USPC ..... 381/191; 381/113; 381/116; 381/431

(58) Field of Classification Search
USPC ..... 381/113, 191, 431, 116, 150, 111, 117; 29/594
See application file for complete search history.

(56) References Cited

U.S. PATENT DOCUMENTS 2,896,025 A * 7/1959 Janszen ..... 381/191
3,517,263 A * 6/1970 Watanabe et al. ..... 361/17
3,894,199 A * 7/1975 Tamura et al. ..... 381/116
3,942,029 A * 3/1976 Kawakami et al. ..... 307/400
3,947,725 A * 3/1976 Lucas ..... 361/17
3,969,655 A 7/1976 Gertsch
6,628,791 B1 * 9/2003 Bank et al. ..... 381/113
2010/0024198 A1 * 2/2010 Chen et al. ..... 29/594
2010/0027814 A1 * 2/2010 Chen et al. ..... 381/150

FOREIGN PATENT DOCUMENTS

TW I274463 2/2007
TW I316323 10/2009

OTHER PUBLICATIONS

Ronan A. R. van der Zee et al., "A Power-Efficient Audio Amplifier Combining Switching and Linear Techniques", IEEE Journal of Solid-State Circuits, vol. 34, No. 7, Jul. 1999, pp. 985-991.

Koch, R. et al., "A Class AB High Swing CMOS Power .Amplifier", Solid-State Circuits Conference, 1991. ESSCIRC '91. Proceedings—Seventeenth European, Issue Date: Sep. 11-13, 1991, Milan, Italy, pp. 65-68.

A. Bellini et al., "Non-Linear Digital Audio Processor for Dedicated Loudspeaker Systems", EEE Transactions on Consumer Electronics, vol. 44, No. 3, Aug. 1998, pp. 1024-1031.

* cited by examiner

*Primary Examiner* — Curtis Kuntz
*Assistant Examiner* — Sunita Joshi
(74) *Attorney, Agent, or Firm* — Jianq Chyun IP Office

(57) ABSTRACT

A driving interface device adaptive to a flat speaker is introduced herein. The driving interface device is coupled with an external sound source for receiving sound signals, and boosts voltage levels of the sound signals to drive the thin flat speaker without using an external power source. In one embodiment, an impedance component is provided in the driving interface device for coupling to the external sound source, so as to drive the flat speaker.

16 Claims, 8 Drawing Sheets

DRIVING INTERFACE DEVICE ADAPTIVE TO A FLAT SPEAKER

CROSS-REFERENCE TO RELATED APPLICATION

This application claims the priority benefit of Taiwan application serial no. 99137799, filed on Nov. 3, 2010. The entirety the above-mentioned patent application is hereby incorporated by reference herein and made a part of specification.

BACKGROUND

1. Technical Field

The disclosure relates to a driving interface device adapted to a flat speaker.

2. Technical Art

A visual sense and a hearing sense are two most direct senses of mankind. For a long time, scientists have tried to develop various renewable visual sense and hearing sense systems. At present, the market is mainly dominated by moving-coil speakers. In recent years, along with a rising requirement for sensory quality, and under a premise that 3C products (computer, communication, consumer electronics) pursue design features of lightness, slimness, shortness and smallness, a power-saving and light and slim speaker designed according to ergonomics is developed, which can be applied to either large-size flat speakers, or small-size earphones of walkmans and stereo mobile phones. In the foreseeable future, such technique may have growing application demands and rapid development.

Electroacoustic speakers are mainly grouped into direct radial and indirect radial electroacoustic speakers, and according to driving methods of the speakers, the speakers mainly catalogued as moving-coil, piezoelectric or electrostatic speakers. The moving-coil speaker is a commonly-used type products with mature techniques, though due to its inherent structural shortage, it cannot be flattened, so that under developing trends of miniaturization of the 3C products and flattening of home theatres, applications of the moving-coil speakers are limited and do not meet the requirements of design features.

Regarding the piezoelectric speaker, based on a piezoelectric effect of a piezoelectric material, when an electric field is exerted to the piezoelectric material to cause deformation, a vibrating film is driven to send sounds. Although a structure of the piezoelectric speaker can be miniaturized and flattened, a sound quality thereof is limited.

Main applications of the electrostatic speakers in the market are hi-end earphones and speakers, and an operation principle of the conventional electrostatic speaker is as followed. Two fixed porous electrodes are used to clamp a vibrating film to form a capacitor, and by supplying a direct current (DC) bias to the vibrating film and supplying an alternating current (AC) voltage of sound frequency to the two fixed porous electrodes, an electrostatic force generated by positive and negative electric fields drives the vibrating film to vibrate, so as to generate sounds. However, the bias of the conventional electrostatic speaker is required to be hundreds to thousands of volts, so that an external high-price and large-size amplifier is required to be connected. Moreover, during a conversion process, a power source of more than 400 volts is required, so that such active driving circuit may have high power consumption, which is not applicable.

Regarding a mass production, individual units have to be fabricated one-by-one according to the conventional technique, and the speakers generally have a fixed size and shape, so that effective mass production cannot be achieved, and cost thereof cannot be reduced. Moreover, soft and thin in appearance and features of low driving voltage and flexibility of the speaker cannot be achieved.

SUMMARY

The disclosure provides a flat speaker having a driving interface device. The driving interface device is used for receiving and converting a sound signal to drive the flat speaker. The driving interface device at least includes an impedance component and a transformer. The impedance component receives the sound signal and coverts it into a first voltage signal. The transformer is coupled to the impedance component for receiving the first voltage signal. The transformer converts the first voltage signal into a second voltage signal, where a level of the second voltage signal is higher than that of the first voltage signal, and the second voltage signal is used for driving the flat speaker for producing sounds.

The impedance component can be a capacitor, a resistor, an inductor, or other components with equivalent effects.

In order to make the aforementioned and other features and advantages of the disclosure comprehensible, several embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

FIGS. 3A-7A are structural schematic diagrams of driving interface devices of a flat speaker according to different embodiments of the disclosure, and FIGS. 3B-7B are circuit structural schematic diagrams of driving interface devices of a flat speaker according to different embodiments of the disclosure

DETAILED DESCRIPTION OF DISCLOSED EMBODIMENTS

Figure 1:
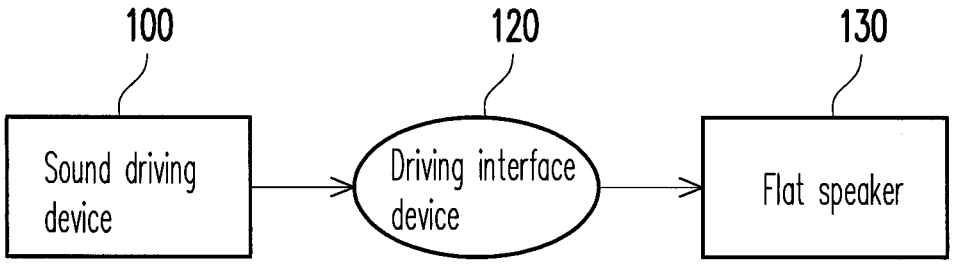
FIG. 1 is a structure schematic diagram of a driving interface device of a flat speaker according to an exemplary embodiment of the disclosure.

An embodiment of the disclosure discloses a driving interface device of a flat speaker. The flat speaker can be a thin flat speaker. The driving interface device can be a passive driving interface device. The driving interface device is, in an example, directly coupled to a sound source for receiving sound signals, and increases a voltage level of the sound signal to a level higher enough to drive the thin flat speaker without using an external power source.

In an embodiment, an impedance component is provided in the driving interface device for coupling to the external sound signal. Considering performance of the flat speaker operating with a medium-high frequency, low-frequency signals can be filtered through capacitor coupling. In another embodiment, if a frequency response of the sound signal is not considered, a resistor can be used to directly couple to the external sound signal.

In an embodiment, the driving interface device may include a transformer having a voltage boost effect, so as to boost a voltage level of the coupled external sound signal to a voltage level within in a range capable of driving the flat speaker. In an embodiment, a predetermined transformation value may be achieved by adjusting a turn ratio of the transformer.

To avoid connecting different sound sources to damage the flat speaker due to excessive power or voltage, in an embodiment, a voltage-limiting circuit is added, which is disposed at an original voltage input terminal of a primary winding side (low voltage) of the transformer, or disposed at a high voltage output terminal of a secondary winding side (high voltage) of the transformer, so as to limit the voltage levels of signals from different sound sources to a desired stable level. To avoid noises such as surges of the signals to cause damage of the whole device, in an embodiment of the driving interface device, an over voltage protection (OVP) circuit may be added.

In an embodiment of the driving interface device, the capacitor capable of filtering the low-frequency signals, the voltage-limiting circuit and the over voltage protection circuit may be integrated as a circuitry to achieve voltage boosting, frequency filtering and protection functions of the driving interface device of the flat speaker.

In the driving interface device of the flat speaker disclosed by the embodiment of the disclosure, the external sound signals are, for example, outputs from a moving-coil amplifier, and a driving object is the flat speaker having an electret vibrating film, though the disclosure is not limited thereto.

Since the external sound signals are outputs from the moving-coil amplifier, not only a hardware space and cost of a driving module are reduced, but also a user can directly integrate the flat speaker to an existing move-coil sound system, so as to strengthen a mediant sound effect or a treble sound effect, in order to achieve a sound system with high quality. According to such design, the sound system using the flat speaker of the disclosure may be popular.

Referring to FIG. 1, FIG. 1 is a structure schematic diagram of a driving interface device of a flat speaker according to an embodiment of the disclosure. The flat speaker of each following embodiment can be a thin flat speaker or other equivalent flat speakers. The driving interface device may be a passive driving interface device or other equivalent driving interface devices. The driving interface device 120 is disposed between a sound driving device 100 and the flat speaker 130. The driving interface device 120 may be a passive driving interface device. The driving interface device 120 is directly coupled to sound signals output by the sound driving device 100, and boosts the sound signals to drive the flat speaker 130. The driving interface device 120 is different from a driving device of a conventional electrostatic speaker. The driving device of the conventional electrostatic speaker requires an external high voltage power source (for example, 400 volts), which is one of the reasons why the electrostatic speaker is not popular. In one of embodiments, the driving interface device 120 does not require an external power source, so that it is adapted to receiving existing sound outputs, for example, outputs of the moving-coil sound system, outputs of the vehicle sound system, or outputs of a general MP3 player, etc.

The impedance component of the disclosure may include a capacitor, a resistor or other equivalent components or combination thereof, and in the following embodiments, the capacitor is taken as an example, though the disclosure is not limited thereto. The impedance component may include a capacitor, which is used to filter the sound signal to generate a first voltage signal. If the impedance component includes a resistor, a voltage dividing function may be designed to divide a voltage of the sound signal to generate the first voltage signal.

In the driving interface device of the embodiment, one or more of the impedance component, the voltage-limiting circuit and the over voltage protection circuit may be implemented in the driving interface device, by which one or more of the functions comprising low-frequency filtering, voltage-limiting and/or over voltage protection may be achieved. Some of embodiments are provided below for further descriptions, though the disclosure is not limited thereto.

Figure 2A:
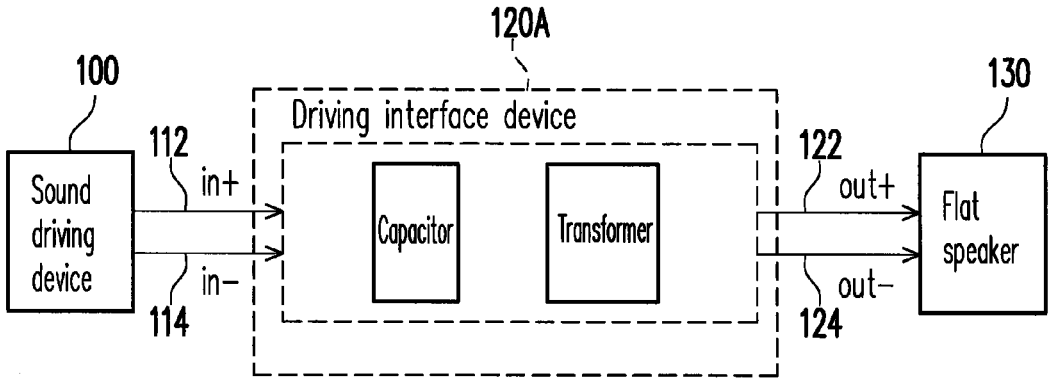
FIG. 2A is structural schematic diagram of a driving interface device of a flat speaker according to an embodiment of the disclosure.
Figure 2B:
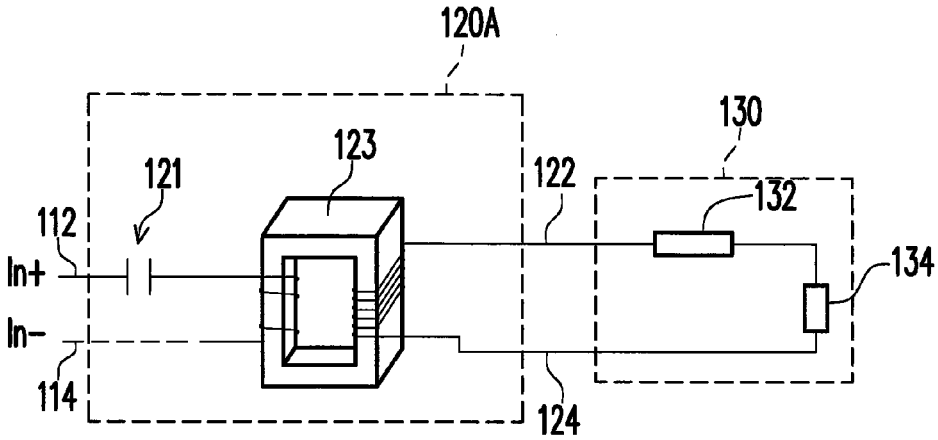
FIG. 2B is structural schematic diagram of a driving interface device of a flat speaker according to an embodiment of the disclosure

FIG. 2A and FIG. 2B are schematic diagrams of a driving interface device of a flat speaker according to one of embodiments of the disclosure. In FIG. 2A, the driving interface device 120A is configured between the sound driving device 100 and the flat speaker 130. Sound signals 112 and 114 (shown as "in+" and "in−" in FIG. 2A) output from positive and negative output terminals of the sound driving device 100 are boosted and filtered by the driving interface device 120A, and driving signals 122 and 124 are accordingly generated with opposite polarities, and are then output to the flat speaker 130 for driving the flat speaker 130 to produce sounds.

In FIG. 2B, an example of a circuit of the driving interface device 120A and an equivalent structure of the flat speaker 130 are illustrated. The driving interface device 120A at least includes a capacitor 121 and a transformer 123. In the transformer 123, a turn ratio of a primary winding side (for a low voltage) and a secondary windings side (for a high voltage) is 1:N, which can boost the low voltage at the primary winding side to a voltage with N times of the low voltage at the second winding side.

Moreover, the capacitor 121 is directly associated with a parasitic inductance of the transformer 123 to form a treble filter, so as to implement a function of a treble boost converter. The driving device of the conventional electrostatic speaker requires a complicated circuit design which at least includes a boost circuit and a filter circuit formed by a plurality of complicated transistors, operation amplifiers, diodes, resistors, capacitors, inductors, etc. Comparatively, in the driving interface device 120A of the embodiment, two components (the capacitor 121 and the transformer 123) are required to achieve the same functions and effects, and by preliminary estimation, about 80% bill of materials (BOM) can be saved, which avails greatly improving price competitiveness of the flat speaker.

The flat speaker 130 of the embodiment may be equivalent to a matching resistor 132 and an equivalent load capacitor 134 connected in series. The flat speaker 130 may have a single or a plurality of flat speaker units. For example, the flat speaker 130 has a plurality of the flat speaker units, a basic operation principle thereof is as follows. Based on the Coulomb's law, two electrode films are disposed opposite to each other, and a vibrating film is added between the two electrode films, where a charge-maintaining process is performed to store charges in an electret layer of the vibrating film. When an alternating current (AC) voltage is applied to the two electrode films, the vibrating film is shifted under a function of the electric field, so that the surrounding air is pushed according to attraction and repulsion functions of the electrode films, so as to produce sounds. Since the flat speaker unit has a lightweight and vibration dispersion thereof is relatively small, it has a better performance in mediant and treble sound field, so that a clear mediant and treble effect can be obtained.

In order to ensure the flat speaker 130 producing sounds with good quality, besides a good flat speaker unit is required, the driving interface device 120A is also a considerable factor. A flexible speaker requires a high-voltage and low-current driving approach to achieve a relatively high volume and a better frequency response, and may not be directly driven with a high-voltage and low-current driving approach by a amplifier, which is suitable for a conventional low-voltage and high-current moving-coil speaker. However, in the design of the driving interface device 120A, the low-voltage signal of the amplifier is converted to the high-voltage signal by a boost circuit, which can be used to drive the flat speaker to generate sounds. Moreover, since the flat speaker unit of the flat speaker 130 is suitable to generate sounds within a frequency range substantially from mediant and treble in audio frequency domain, when the driving interface device 120A boost the low-voltage signals, it is also required to filter out the low-frequency sound signals, and then transmits the high-voltage sound signals in the sound field of mediant or treble to the flat speaker 130 for generating sounds accordingly. The capacitor 121 of the driving interface device 120A may be associated with the parasitic inductance of the transformer 123 to form the treble filter, so as to implement a function of a treble boost converter.

Figure 3A:
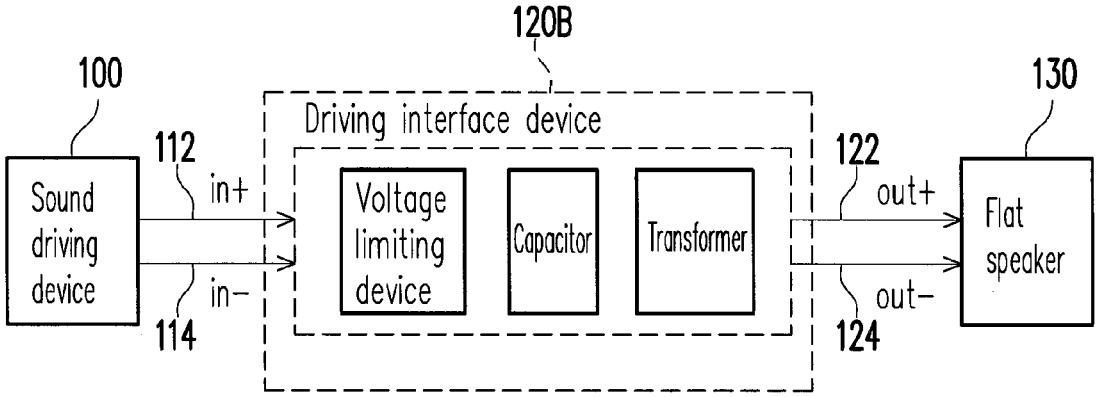
Figure 3B:
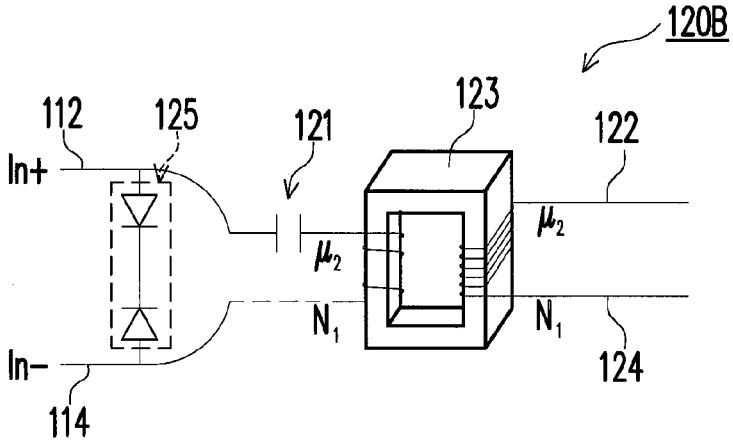

FIG. 3A and FIG. 3B are schematic diagrams illustrating a driving interface device of a flat speaker according to another one of embodiments of the disclosure. A circuit of the embodiment is similar to that of FIG. 2A or FIG. 2B, and same reference numbers are used to denote the same devices, which are not repeatedly depicted herein. In FIG. 3A, the driving interface device 120B is configured between the sound driving device 100 and the flat speaker 130, and in FIG. 3B, a circuit of the driving interface device 120B is illustrated. The driving interface device 120B includes the capacitor 121, the transformer 123 and a voltage limiter 125. Besides the capacitor 121 and the transformer 123 of FIG. 2B, the driving interface device 120B further includes the voltage limiter 125 disposed at the primary winding side (low voltage) of the transformer 123 to serve as a voltage limiting protection device of the flat speaker 130. In an embodiment, the voltage limiter 125 includes two counter-connected diodes or zenor diodes, so as to limit a voltage difference of two ends of the voltage limiter 125. In other embodiments, the voltage limiter 125 may also include more than two diodes or other combinations, which may achieve the voltage limitation between two ends of the voltage limiter 125.

Figure 4A:
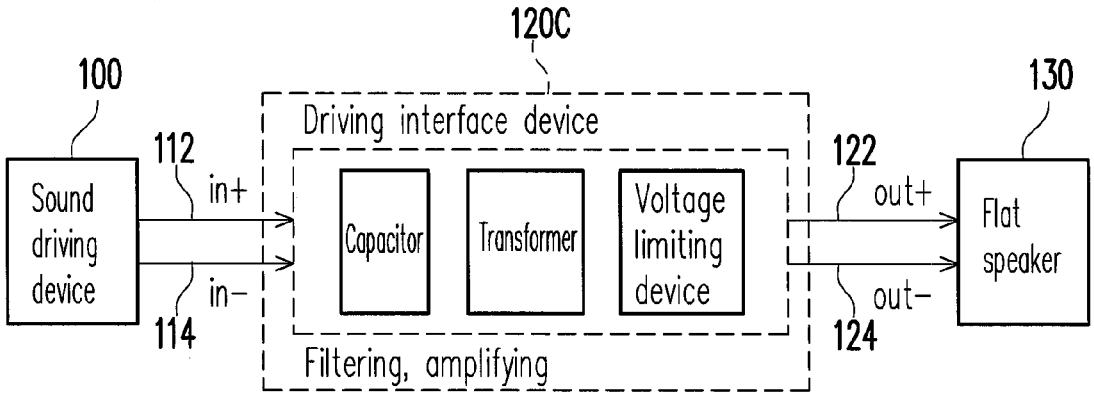
Figure 4B:
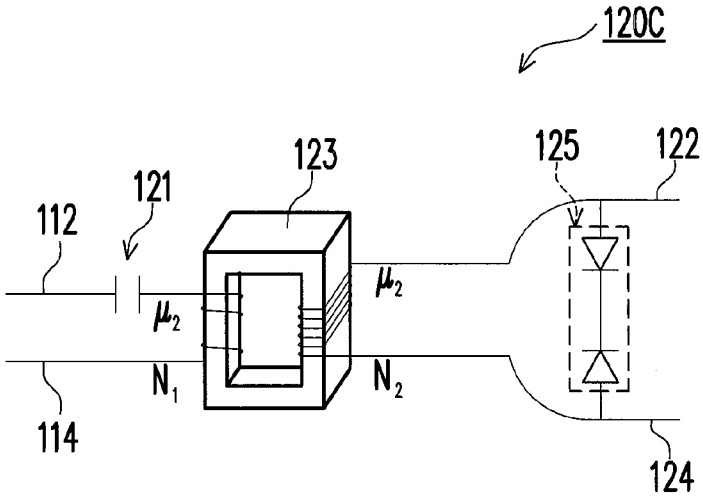

FIG. 4A and FIG. 4B are schematic diagrams illustrating a driving interface device of a flat speaker according to still another one of embodiments of the disclosure. The arrangement of the embodiment is similar to that in FIG. 3A or FIG. 3B, and same reference numbers are respectively used to denote the same devices, which are not repeatedly depicted herein. In FIG. 4A, the driving interface device 120C is configured between the sound driving device 100 and the flat speaker 130. A difference between FIG. 4B and FIG. 3B is that the voltage limiter 125 is disposed at the secondary winding side (high voltage) of the transformer 123, so that a voltage limiting range of voltage limiting components used by the voltage limiter 125 have to be higher than that of voltage limiting components of the voltage limiter 125 of FIG. 3B, so as to comply with the voltages of the driving signals 122 and 124 output to the flat speaker 130.

Figure 5A:
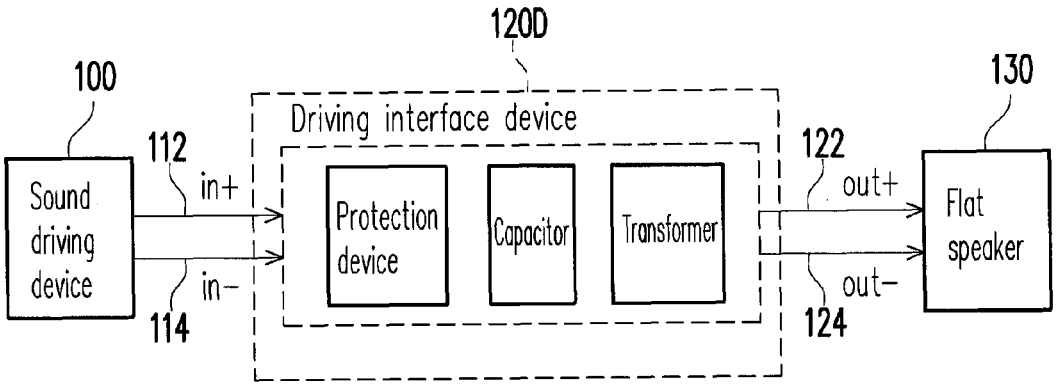
Figure 5B:
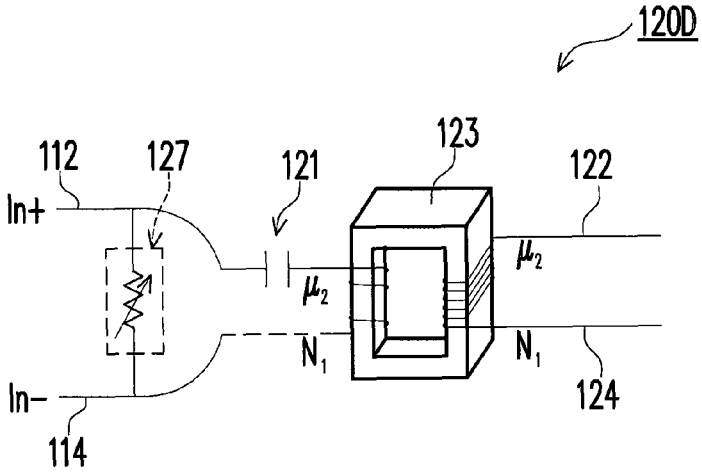

FIG. 5A and FIG. 5B are schematic diagrams illustrating a driving interface device of a flat speaker according to one of embodiments of the disclosure. The arrangement of the embodiment is similar to that in FIG. 2A or FIG. 2B, and same reference numbers are respectively used to denote the same devices, which are not repeatedly depicted herein. In FIG. 5A, the driving interface device 120D is configured between the sound driving device 100 and the flat speaker 130. In FIG. 5B, a circuit of the driving interface device 120D is illustrated. The driving interface device 120D includes the capacitor 121, the transformer 123 and a protection circuit 127. Besides the capacitor 121 and the transformer 123 as illustrated in FIG. 2B, the driving interface device 120B further includes the protection circuit 127 disposed at the primary winding side (low voltage) of the transformer 123 to serve as a surge protection device of the flat speaker 130.

Figure 6A:
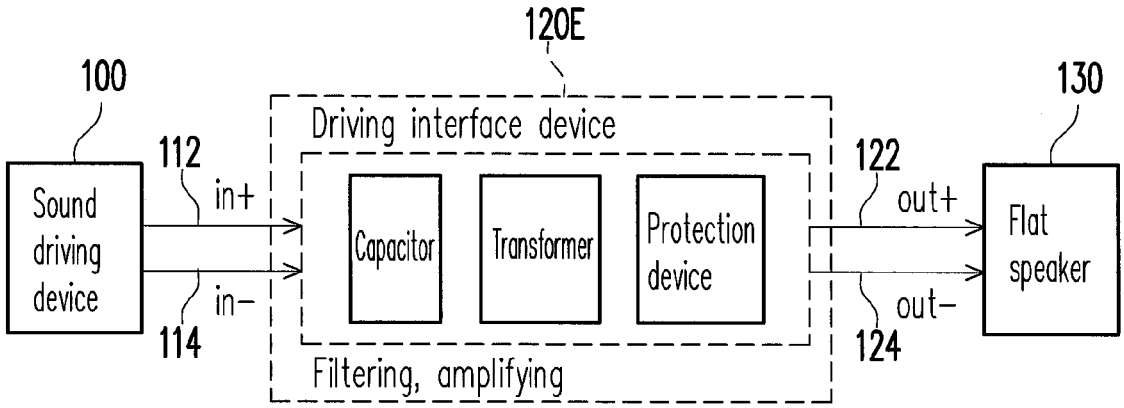
Figure 6B:
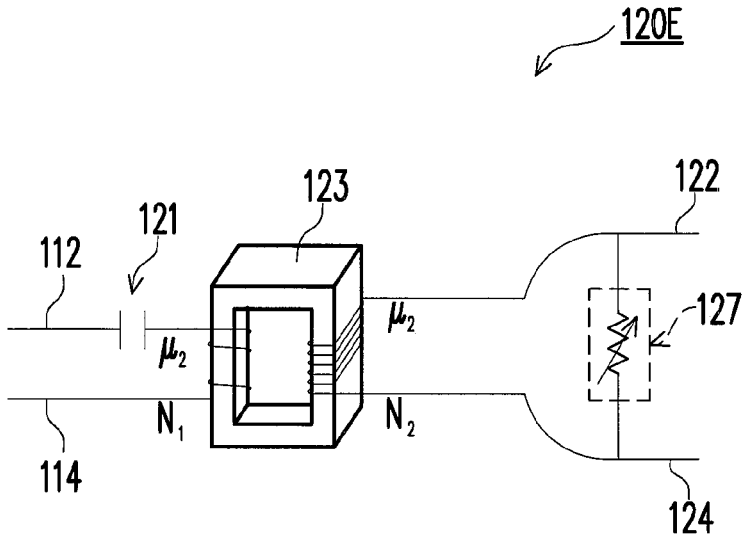

FIG. 6A and FIG. 6B are schematic diagrams illustrating a driving interface device of a flat speaker according to one of embodiments of the disclosure. The arrangement of the embodiment is similar to that in FIG. 5A or FIG. 5B, and same reference numbers are respectively used to denote the same devices, which are not repeatedly depicted herein. In FIG. 6A, the driving interface device 120E is configured between the sound driving device 100 and the flat speaker 130. A difference between FIG. 6B and FIG. 5B is that the protection circuit 127 is configured at the secondary winding side (high voltage) of the transformer 123, so that the surge protection device used by the protection circuit 127 is able to tolerate relatively high operation voltage.

Figure 7A:
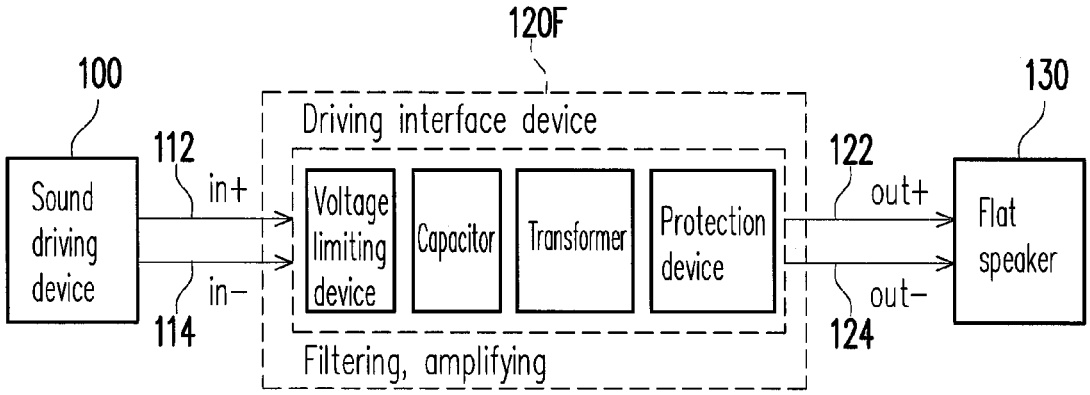
Figure 7B:
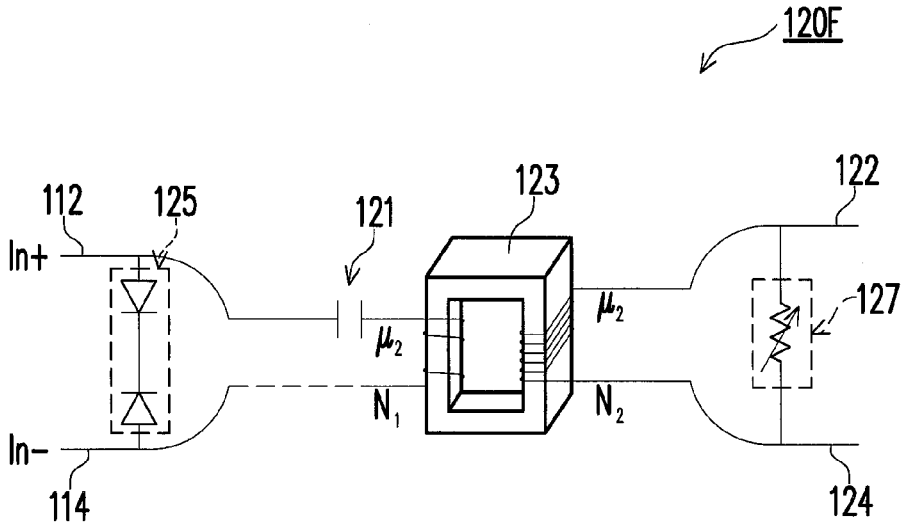

FIG. 7A and FIG. 7B are schematic diagrams illustrating a driving interface device of a flat speaker according to one of embodiments of the disclosure. The arrangement of the embodiment is similar to that of one of the aforementioned embodiments, and same reference numbers are respectively used to denote the same devices, which are not repeatedly depicted herein. In FIG. 7A, the driving interface device 120F is configured between the sound driving device 100 and the thin flat speaker 130. In FIG. 7B, a circuit of the driving interface device 120F is illustrated. The driving interface device 120F includes the capacitor 121, the transformer 123, the voltage limiter 125 and the protection circuit 127. Besides the capacitor 121 and the transformer 123 as depicted in FIG. 2B, the driving interface device 120F further includes the voltage limiter 125 and the protection circuit 127 respectively disposed at the primary winding side (low voltage) and the secondary winding side (high voltage) of the transformer 123 to respectively serve as a voltage limiting component and a surge protection device of the flat speaker 130. As described in the aforementioned embodiments, as long as suitable components are used, the voltage limiter 125 and the protection circuit 127 may be configured at either of the secondary winding side (high voltage) or the primary winding side (low voltage) of the transformer 123, which is not limited by the disclosure.

In one of the embodiments, the protection circuit 127 may be a surge protection device, which is generally referred to as an "over voltage protection device". A function of the surge protection device is to limit a transient over-voltage fled into a signal transmission line within a tolerance voltage range of an apparatus or a system, so as to prevent the apparatus or the system from damaging. Types of the surge protection devices are different for usages, though the surge protection device at least includes a nonlinear voltage limiting component. Basic components used in the surge protection device may include a discharge gap, a gas discharge tube, a voltage dependent resistor, a suppression diode and a choke coil, etc. The surge protection device may be a voltage limiting protection device, and an operation principle thereof is that it has a high impedance when there is not transient over voltage, and as the surge current and the voltage are gradually increased, the impedance thereof is gradually decreased, and a current-voltage characteristic thereof is strong nonlinearity. Components used in such device may include a zinc oxide varistor, a voltage dependent resistor, a suppression diode and a zenor diode, etc, alone or any combination thereof.

In each of the aforementioned driving interface devices of the flat speaker having the voltage limiting protection function, besides the capacitor and the transformer are included, the voltage limiter and the surge protection device can also be integrated to serve as the voltage limiting protection device of the flat speaker. Therefore, even though the transformer amplifies the signals, a voltage lower than a highest rated voltage of the flat speaker can still be provided without damaging the device.

Figure 8:
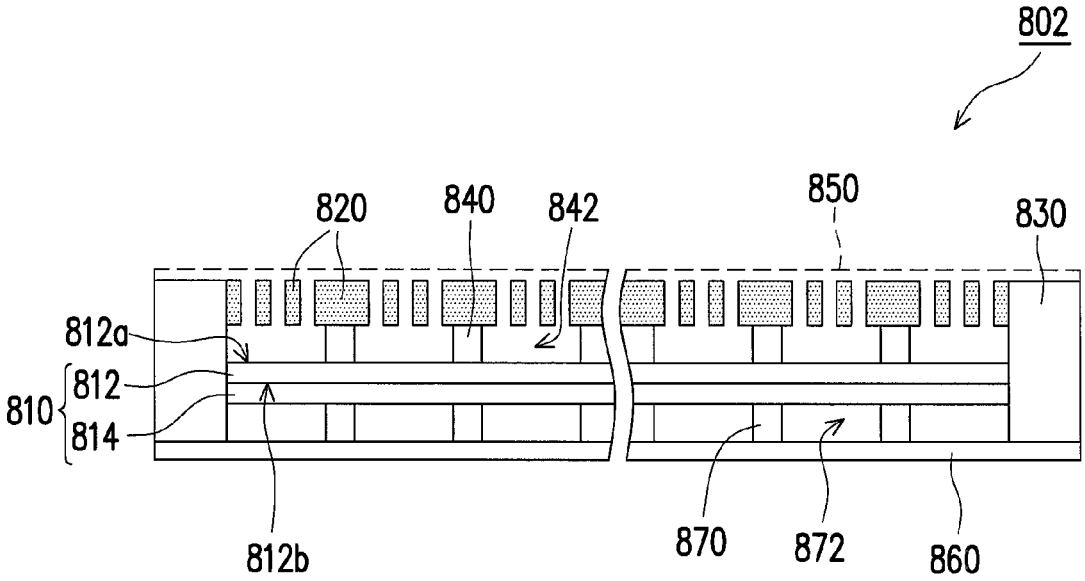
FIG. 8 is a schematic diagram of a flat speaker according to an embodiment of the disclosure.

The flat speaker mentioned in the aforementioned embodiments is described below. FIG. 8 is a schematic diagram of a flat speaker according to an embodiment of the disclosure.

The flat speaker 802 may have a plurality of working areas relative to a vibrating film 810 between any two layers of adjacent supporting members. The working areas at both sides of the vibrating film 810 can be defined according to a same method or different methods. Chamber structures illustrated in FIG. 8 may have two chamber spaces, so as to form resonant sound fields or resonant effect of the speaker, where one of the chamber spaces is located above the vibrating film 810, and another one is located under the vibrating film 810. The flat speaker 802 includes a plurality of supporting members 840 and 870, and the supporting members 840 and 870 can be designed to have specific shapes, which are disposed in the upper and lower chamber spaces to respectively support a porous electrode 820 and the vibrating film 810, and support a substrate 860 and the vibrating film 810. In an embodiment, the upper chamber space of FIG. 8 is a sound pick-up hole region 842, and the lower chamber space of FIG. 8 opposite to the sound pick-up hole region 842 is a chamber structure 872. The lower chamber space between the substrate 860 and the vibrating film 810 can form the resonant sound fields of the flat speaker 802 through a plurality of the working areas of the vibrating film 810 between any two adjacent supporting members 870.

The flat speaker 802 includes the vibrating film 810, the port electrodes 820, a frame supporting member 830, and a plurality of the supporting members 840 between the porous electrode 820 and the vibrating film 810. The porous electrode 820 is located at a side of the vibrating film 810, and the chamber structure 872 is located at another side of the vibrating film 810. The chamber structure 872 is formed by the substrate 860 and the supporting members 870 between the vibrating film 810 and the substrate 860. The substrate 860, the supporting members 870, and the chamber structure 872 are selective, i.e. in the flat speaker unit, the substrate 860, the supporting members 870, and the chamber structure 872 can be omitted. Moreover, the substrate 860 can be replaced by another porous electrode, i.e. the flat speaker 802 has two pieces of porous electrodes respectively located at two sides of the vibrating film 810. In addition, the substrate 860 and the vibrating film 810 can be connected through the frame supporting member 830, or the substrate 860 and the vibrating film 810 can be connected through another frame supporting member, so that the frame supporting member 830 connects the porous electrode 820 and the vibrating film 810, and the other supporting member connects the substrate 860 and the vibrating film 810.

The vibrating film 810 may include an electret layer 812 and a metal thin film electrode 814. In some embodiments, an upper surface 812*a* of the electret layer 812 can be electrically coupled to the frame supporting member 830 and the supporting members 840, and a lower surface 812*b* of the electret layer 812 can be electrically coupled to the metal thin film electrode 814. An insulation layer (not shown) can be disposed between the electret layer 812 and the metal thin film electrode 814.

A material of the porous electrode 820 includes a metal material, a non-metal material, a conductive material or a non-conductive material. In an embodiment, the porous electrode 820 can be formed by plating a metal thin film layer on a piece of paper or an extremely thin non-conductive material.

When the material of the porous electrode 820 is the non-conductive material plated with the metal thin-film layer, the non-conductive material can be plastic, rubber, paper, non-conductive cloth (cotton fiber or polymer fiber) or other non-conductive materials, and the metal thin film can be aluminium, gold, silver, copper, bimetals of nickel/gold, indium tin oxide (ITO), indium zinc oxide (IZO), polyethylenedioxythiophene (PEDOT), etc., or alloy, or any combination of the above materials or the equivalents thereof. When the material of the porous electrode is the conductive material, the conductive material can be metal (iron, copper, aluminium or alloy thereof), conductive cloth (metal fiber, metal oxide fiber, carbon fiber or graphite fiber), etc., or any combination of the above materials or other materials.

A material of the electret layer 812 can be a dielectric material, where such material can be processed or charged to maintain electrostatic charges for a period of time or an extending time interval, and after being charged, the material has a charge-maintaining effect or an electrostatic effect. The eelctret layer 812 may include one or multiple dielectric layers. The dielectric material includes fluorinated hylenepropylene (FEP), polytetrafluoethylene (PTFE), polyvinylidene fluoride (PVDF), a fluoropolymer material, or other suitable materials. The above dielectric material may include micron-scale or nano-scale voids. Since the electret layer 812 may maintain the electrostatic charges for an extending time interval, and may have a piezoelectric property after being charged, the voids in the vibrating film 810 can enhance a transmission effect and the piezoelectric property of the dielectric material. In an embodiment, after a corona charging process, dipolar charges can be generated and maintained in the dielectric material to produce the charge-maintaining effect or the electrostatic effect.

In order to provide a suitable tension and/or vibration effect of the vibrating film 810, the metal thin film electrode 814 can be an extremely thin metal thin film electrode. For example, a thickness of the metal thin film electrode 814 is between 0.2 μm and 0.8 μm or between 0.2 μm and 0.4 μm. In some embodiments, the thickness is about 0.3 μm, and an illustrated dimension range thereof is generally regarded as "ultrathin".

Taking the electret layer 812 having negative charges as an example, when an input sound signal is supplied to the porous electrode 820 and the metal thin film electrode 814, a positive voltage of the input sound signal may attract the negative charges of the vibrating film 810, and a negative voltage of the input sound signal may repulse the negative charges of the vibrating film 810, so that the vibrating film 810 is moved towards a direction. Comparatively, when a voltage phase of the input sound signal is changed, the positive voltage also attracts the negative charges of the vibrating film 810, and the negative voltage repulses the negative charges of the vibrating film 810, so that the vibrating film 810 is moved towards a direction opposite to the above direction. As the vibrating film 810 is repeatedly moved back and forth, the surrounding air is compressed to produce sounds due to interaction of different forces of different directions. In other words, the porous electrode 820 and the vibrating film 810 are interacted in response to the input sound signal, so that the vibrating film 810 is vibrated to produce corresponding sounds.

In an embodiment, a thin film 850 can be selectively used to cover one side or two sides of the flat speaker 802. In some cases, the thin film 850 can be omitted. The thin film 850 is air-permeable and waterproof, which can be formed by CORE-TEX® thin film containing expended polytetrafluoroethylene (ePTFE), etc. The CORE-TEX® or a similar material has effects of waterproof and air absorption, so as to prevent the electret layer 812 from losing charges and reducing its charge-maintaining effect.

The working areas of the vibrating film 810 can be formed between any two adjacent supporting members 840 and between the porous electrode 820 and the vibrating film 810. The working areas of the upper chamber structure 842 are used to produce resonant sound fields of the flat speaker 802. The working areas of the vibrating film 810 can be formed between any two adjacent supporting members 870 and between the substrate 860 and the vibrating film 810. The working areas of the lower chamber structure 872 are also used to produce the resonant sound fields of the flat speaker 802. Positions, heights and shapes of the supporting members 840 and the supporting members 870 can be adjusted as a part of design of the flat speaker 802. Moreover, the number of the supporting members 870 can be greater than, equal to or less than that of the supporting members 840, and the supporting members 840 or the supporting members 870 can be directly fabricated on or above the porous electrode 820 or the substrate 860.

The chamber structure is closed to the surface of the metal thin film electrode 814 of the vibrating member 810, which can be designed while considering sound features of the speaker or other hearing sense or structure factors. The chamber structure may include a sound-absorbing material, and the supporting members can be designed to have various shapes. The frame supporting member 830 used for forming the chamber spaces may have sound holes for releasing pressures of the generated sounds, so as to achieve a better sound field effect in some cases.

A driving circuit module used for providing voltages to the porous electrode 820 can be independent to and electrically connected to the flat speaker 802. Therefore, a whole weight and a whole size of the driving circuit module containing a heat-dissipation device and the flat speaker 802 are relatively large. Therefore, the disclosure provides a flat speaker apparatus, in which the flat speaker can be integrated with the driving circuit module, and the heat-dissipation device in the driving circuit module is omitted, so as to reduce the whole weight and size thereof.

In the embodiment of FIG. 8, two chamber structures are illustrated, though the disclosure may have a single chamber structure, i.e. the chamber structure 872 can be omitted.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A driving interface device of a flat speaker, comprising:

an impedance component, for receiving a sound signal, and converting the sound signal into a first voltage signal; and a transformer, coupled to the impedance component, for receiving the first voltage signal and converting the first voltage signal into a second voltage signal, wherein a level of the second voltage signal is higher than that of the first voltage signal, and the second voltage signal drives the flat speaker to produce sounds, wherein the flat speaker comprises:

a porous electrode; and an electret vibrating film, wherein the porous electrode and the electret vibrating film are interacted in response to the second voltage signal, so that the electret vibrating film is vibrated to produce corresponding sounds; and a plurality of first supporting members disposed between the porous electrode and the electret vibrating film, wherein working areas of the vibrating film are formed between any adjacent two of the plurality of the first supporting members.

2. The driving interface device of the flat speaker as claimed in claim 1, wherein the impedance component comprises a capacitor for filtering the sound signal to generate the first voltage signal.

3. The driving interface device of the flat speaker as claimed in claim 1, wherein the impedance component comprises a resistor for dividing a voltage of the sound signal to generate the first voltage signal.

4. The driving interface device of the flat speaker as claimed in claim 1, wherein the transformer has a primary winding side and a secondary winding side, and a turn ratio of the primary winding side and the secondary winding side is 1:N, wherein N is an integer and N>1.

5. The driving interface device of the flat speaker as claimed in claim 1, further comprising a voltage limiting device arranged at the primary winding side of the transformer for limiting a voltage level of the first voltage signal.

6. The driving interface device of the flat speaker as claimed in claim 5, wherein the voltage limiting device comprises a plurality of diodes or a plurality of zenor diodes.

7. The driving interface device of the flat speaker as claimed in claim 1, further comprising a voltage limiting device arranged at the secondary winding side of the transformer for limiting a voltage level of the second voltage signal.

8. The driving interface device of the flat speaker as claimed in claim 7, wherein the voltage limiting device comprises a plurality of diodes or a plurality of zenor diodes.

9. The driving interface device of the flat speaker as claimed in claim 1, further comprising a protection device arranged at the primary winding side of the transformer for preventing a surge of the first voltage signal.

10. The driving interface device of the flat speaker as claimed in claim 1, further comprising a protection device disposed at the secondary winding side of the transformer for preventing a surge of the second voltage signal.

11. The driving interface device of the flat speaker as claimed in claim 9, wherein the protection device comprises a nonlinear voltage limiting component.

12. The driving interface device of the flat speaker as claimed in claim 11, wherein the nonlinear voltage limiting component comprises one of a zinc oxide varistor, a voltage dependent resistor, a suppression diode and a zenor diode, or combinations thereof.

13. The driving interface device of the flat speaker as claimed in claim 1, further comprising a voltage limiting device and a protection device disposed at one of the primary winding side and the secondary winding side of the transformer, wherein the voltage limiting device limits a voltage level of the first voltage signal or the second voltage signal, and the protection device prevents a surge of the first voltage signal or the second voltage signal.

14. The driving interface device of the flat speaker as claimed in claim 1, wherein the sound signal is generated by a sound driving device.

15. The driving interface device of the flat speaker as claimed in claim 1, wherein the flat speaker further comprises a substrate; and a plurality of second supporting members disposed between the substrate and the electret vibrating film, wherein more working areas of the vibrating film are formed between any adjacent two of the plurality of the second supporting members.

16. A flat speaker device, comprising:

a flat speaker, comprises a porous electrode; and an electret vibrating film, wherein the porous electrode and the electret vibrating film are interacted in response to the second voltage signal, so that the electret vibrating film is vibrated to produce corresponding sounds; and a plurality of first supporting members disposed between the porous electrode and the electret vibrating film, wherein working areas of the vibrating film are formed between any adjacent two of the plurality of the first supporting members.

a driving circuit, integrated with an impedance component, a transformer and a voltage limiting device in a circuitry, wherein the impedance component receiving a sound signal, and converting the sound signal into a first voltage signal;

the transformer, coupled to the impedance component, receiving the first voltage signal and converting the first voltage signal into a second voltage signal, wherein a level of the second voltage signal is higher than that of the first voltage signal, and the second voltage signal drives the flat speaker to produce sounds; and the voltage limiting device arranged at the secondary winding side of the transformer for limiting a voltage level of the second voltage signal.

* * * * *